United States Patent [19]

Huber

[11] 4,123,738

[45] Oct. 31, 1978

[54] HIGH VOLTAGE CURRENT LIMITING FUSE

[75] Inventor: William J. Huber, Racine, Wis.

[73] Assignee: McGraw-Edison Company, Elgin, Ill.

[21] Appl. No.: 797,063

[22] Filed: May 16, 1977

[51] Int. Cl.[2] ..... H01H 85/04

[52] U.S. Cl. ..... 337/159; 337/295

[58] Field of Search ..... 337/158, 159, 160, 161, 337/290, 292, 295, 162

[56] References Cited

U.S. PATENT DOCUMENTS

| | | | |
|---|---|---|---|
| 3,813,627 | 5/1974 | Koch | 337/159 X |
| 3,835,431 | 9/1974 | Rosen et al. | 337/290 X |

*Primary Examiner*—George Harris

*Attorney, Agent, or Firm*—Thomas E. McDonald; Jon Carl Gealow; Ronald J. LaPorte

[57] ABSTRACT

An improvement in a high voltage, full-range, current limiting fuse of the type which includes a perforated ribbon main fusible element wound about a gas evolving spider within a sand filled enclosure, and having a portion in intimate contact with a body of low melting temperature alloy, and an auxiliary fusible element whose ends are closely spaced from the main element on opposite sides of the alloy body.

The portions of the main element in contact with the alloy body, and adjacent the ends of the auxiliary element are relatively long portions having a uniform cross sectional area less than half the cross sectional area of an unperforated remaining portion of the main element, to thereby reduce the time required for the fuse to clear the low magnitude fault current.

3 Claims, 10 Drawing Figures

4B

4C

4D

4E

4F

4G

HIGH VOLTAGE CURRENT LIMITING FUSE

BACKGROUND OF THE INVENTION

1. Field of the Invention

The invention relates generally to fuses, and more particularly, to a full range current limiting fuse, that is to a current limiting fuse that can interrupt any current shown on its published minimum melt time-current curves.

2. Description of the Prior Art

Current limiting fuses conventionally comprise a fusible element embedded in a granular inert material of high dielectric strength such as sand or finely divided quartz. Usually the fusible element is in the form of one or more thin conductors of silver wound on a supporting insulating core or spider. When subjected to current of fault magnitude, the fusible element attains fusing temperature and vaporizes, whereby arcing occurs and the metal vapors rapidly expand to many times the volume originally occupied by the fusible element and are thrown into the spaces between the granules of inert filler material where they condense and are no longer available for current conduction. The current limiting effect results from the interaction of the metal vapors and the inert granular material surrounding the fusible element. The physical contact between the hot arc and the relatively cool granules causes a rapid transfer of heat from the arc to the granules, thereby dissipating most of the arc energy with very little pressure build-up within the fuse enclosure. The vapors of silver have relatively low conductivity unless their temperature is particularly high, and the temperature of the silver vapors is rapidly reduced by the quartz-sand filler until the vapors will not support a flow of current. Consequently, a high resistance is, in effect, inserted into the path of the current and initially limits the current to a magnitude which is only a small fraction of that available in the circuit.

The quartz sand particles in the immediate vicinity of the arc fuse become partial conductors at the high temperature of the arc and form a fulgurite, or semi-conductor. The fulgurite resulting from fusion and sintering of the quartz sand particles is in the nature of a glass body, and as it cools it loses its conductivity and becomes an insulator.

High voltage, high amperage current limiting fuses conventionally employ fusible elements of silver ribbon having serially related portions of relatively small cross sectional area and intermediate portions of relatively large cross sectional area, for example, a silver ribbon provided with a plurality of circular spaced apart perforations which determine the portions where the fusion of the fusible element is initiated on currents of short circuit magnitude. The perforations form portions of reduced cross sectional area which limit the peak arc voltage and make it possible to distribute the thermal duty of the arc quenching granular material relatively evenly over the entire filler body.

If such a fuse is subject to fault currents of high magnitude, all the portions of small cross sectional area fuse and vaporize almost simultaneously, resulting in formation of arclets in series and controlling the transient voltage across the fuse.

These fusible ribbons generally include a "M" spot, that is, a body of low melting temperature alloy such as tin-lead solder in intimate contact with the ribbon adjacent the midpoint thereof, to assure that on fault currents of low magnitude, the first arc gap will be formed near the middle of the fuse. At melting currents flowing for prolonged periods, the fusible ribbons become hot enough to melt the alloy bodies, and the amalgamation of the silver and alloy causes a hot spot with high enough resistance to melt the ribbon at this point. However, on large magnitude fault currents, the alloy element has little or no effect and the silver elements vaporize at the fusion temperature for the silver.

When the fuse is subjected to low magnitude overload currents, the arc gap first formed at the "M" spot is generally progressively enlarged by vaporization of the silver element until the gap is of sufficient length to effect final interruption of the circuit and consequently the fulgurite produced by the arcing is generally continuous. When such interruption of small overload currents result in arcing over a plurality of of cycles, the arc energy tends to be large. The relatively large arc energy and the dissipation of additional heat resulting from $I^2r$ losses caused by the flow of follow current through the fulgurite combine to delay the cooling of the central portion of the fulgurite which remains partially conductive, and only the end portions of the fulgurite, where the arc contacts are relatively cool filler particles, tend to interrupt the arc. Most of the voltage appears across the ends of the fulgurite, which are of higher resistance and the hot central portions thereof, and tends to flash over the hot gases, and consequently reignition of the fusible element and post-interruption failure can occur when current limiting fuses of this type control overload currents of small magnitude.

In order to produce additional points of arcing in the fusible element during protracted low magnitude overload currents, some or all of the portions of reduced cross sectional area of the fusible element can be designed to be melted by the heating resulting from the $I_2r$ losses occurring in these portions when a low magnitude overload current flows therethrough. However, such a drastic reduction in the cross sectional areas or lengths of these portions of the main element greatly reduces the transient surge currents that the fuse can withstand.

In the current limiting fuse disclosed in U.S. Pat. No. 3,243,552 issued Mar. 29, 1966, to Harvey W. Mikulecky, not only are additional arcing points established in the main fusible element by means other than the $I^2r$ loss through the element, but also the first arcing point at the "M" spot is temporarily extinguished to allow this portion of the fulgurite to cool and become a nonconductor. This is accomplished by the use of an auxiliary fusible element having its ends closely and accurately spaced from the main fusible element on opposite sides of the "M" spot, and having a minimum melting current sufficiently less than that of the main fusible element so that, when the minimum melt current is reached for the main element, good low current clearing characteristics exist for the auxiliary element. When this fuse is subjected to a low magnitude overload or fault current, the main fusible element opens at its "M" spot and starts to arc and burn back. When the arc voltage crossing this area is high enough, the auxiliary gaps are sparked over, resulting in the auxiliary element becoming the path for the current and extinguishing the arc at the "M" spot, allowing the fulgurite at the "M" spot to cool and lose its conductivity. While the arc exists at the auxiliary gaps they cut through and burn back the main ribbon element. The auxiliary element then clears the circuit and the arcs at the gaps go out. If not enough of the main element has been consumed to withstand the recovery voltage across the fuse, the gaps in the main ribbon element at the auxiliary locations and the "M" spot restrike and burn back until a sufficient dielectric path has been established to withstand the recovery voltage.

However, some of the fuse ratings of this design of current limiting fuse have a particularly hard interruption duty at low magnitude fault overload currents because of the long arcing times, up to 100 cycles, required for the fuse to clear. These long arcing times release large amounts of arc energy at discrete locations in the fuse which can thoroughly damage the fuse components. Also, when the fusible element is wound about a spider of a material which evolves gas in the presence of an arc for cooling the inert granules, as also disclosed in the above referenced U.S. Pat. No. 3,243,552, the excessively long arcing times can cause an excessive amount of gas generation in the fuse. When this fuse is used in tight containers, this gas can escape from the fuse and condense on adjacent dielectric materials to cause a flashover of these materials.

SUMMARY OF THE INVENTION

Therefore, it is a principal object of the invention to disclose a current limiting fuse of the type having a main fusible element with an "M" spot adjacent thereto, and an auxiliary fusible element having ends which are closely spaced from the main element on opposite sides of the "M" spot, which includes elements for significantly reducing the arcing time required to clear low magnitude fault currents without appreciably effecting the minimum melt $I^2t$ value, the time-current curve, or the let through $I^2t$ value of the fuse.

This object is achieved in the present invention by reducing the mass of the main fusible element in the auxiliary gap and "M" spot areas to allow a much faster rate of burn back. The section of the main fusible element between these sections of reduced area at the auxiliary gaps and the "M" spot are of the same construction as the main fusible ribbons conventionally used in fuses of this type, that is, these sections have similarly related portions of relatively small cross sectional area and intermediate portions of relatively large cross sectional area in which, when the fuse is subjected to a high magnitude fault current, all the portions of small cross sectional area fuse and vaporize almost instantaneously to thus control the transient voltage across the fuse. While the optimum ratio of the lengths of the reduced areas at the auxiliary gap and the "M" spot areas to the total length of the main fusible element depends upon the size and shape of the main fusible element, generally this ratio cannot exceed 50% without detrimentally increasing the arc voltage on high fault currents. In any case, the individual length of each of these three reduced areas is much longer than the portions of relatively small cross sectional area in the conventional connecting sections of the main element. Consequently, the thermal conductivity between a central portion of these reduced areas at the auxiliary gaps and the "M" spot to an adjacent section of large cross sectional area is less than the thermal conductivity between the small and large cross sectional areas of the remaining conventional sections of the main element.

Therefore, to achieve the same short time overcurrent capability as a conventional fuse of this type, these reduced areas of the main fuse element at the "M" spot and the auxiliary gaps must be somewhat larger in cross sectional area than the smallest cross sectional area of the remaining sections of the main element.

BRIEF DESCRIPTION OF THE DRAWINGS

These and other objects and advantages of the invention will be more readily apparent from the following detailed description when taken in conjunction with the accompanying drawings wherein:

FIGS. 4A–4G are schematic linear views of the main and auxiliary fusible elements of FIG. 3, illustrating the sequential fuse operation when interrupting small magnitude fault currents.

DESCRIPTION OF A PREFERRED EMBODIMENT

Figure 1:
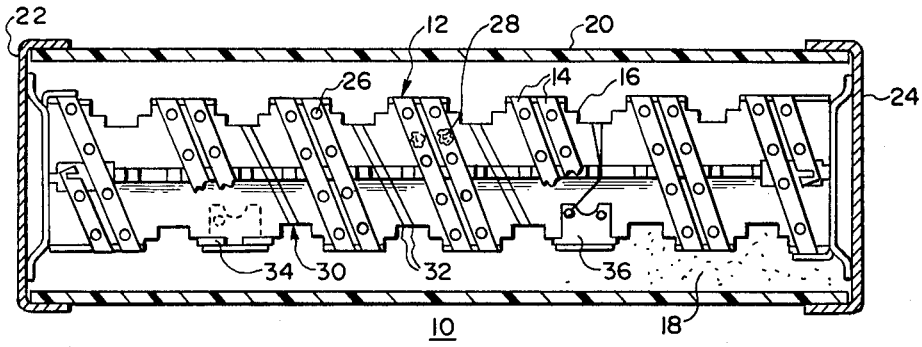
FIG. 1 is a sectional view of a known type of current limiting fuse, similar to that described in U.S. Pat. No. 3,243,552.

Referring now to FIG. 1, a fuse 10 includes a main fusible element 12 consisting of two silver ribbons 14 helically wound about a supporting spider of electrically insulating material. The spider 16 is embedded in a mass of granular inert material 18 of high dielectric strength, such as sand, within an electrically insulating tubular housing 20 which is closed at its ends by respective terminal end caps 22, 24. Each end of the silver fusible ribbons 14 is electrically connected to a respective end terminal 22, 24. Each of these silver ribbons 14 is provided with a plurality of circular spaced apart perforations 26 which reduce the cross sectional area of each ribbon 14 and thus determine the portions of each ribbon where fusion is initiated when the fuse is subjected to high magnitude fault currents. A body 28 of low melting temperature alloys such as tin-lead solder, hereinafter referred to as the "M" spot, is disposed on each of the silver ribbons 14 at approximately the midpoint thereof. These "M" spots 28 allow the fusible ribbons 14 to melt at a temperature in the range of 400°–600° F. when the fuse is subjected over a long period of time to low magnitude overcurrents as compared to the 1760° F. melting temperature for pure silver, and thus assures that the initial melting and arcing within the fuse caused by a low magnitude overcurrent occurs in a central portion of the fuse.

An auxiliary fusible element 30 consists of two fusible wires 32 which are also helically wound about the spider 16. Each end of the auxiliary wires 32 is connected to a respective arc gap electrode 34, 36 disposed on the spider 16 on opposite sides of the "M" spots 38, and accurately spaced from each of the main fusible element ribbons 14 to form an air gap at each end of the auxiliary fusible element between the main and auxiliary elements.

Figure 2:
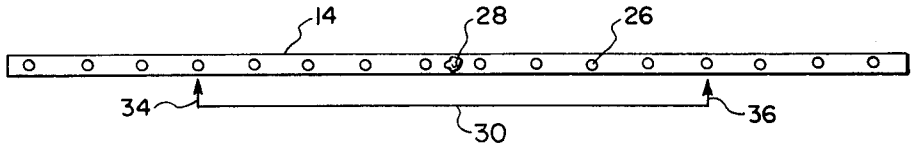
FIG. 2 is a schematic view of the main and auxiliary fusible elements of the current limiting fuse of FIG. 1, in which these elements are illustrated in linear form rather than helically wound as in the actual construction as shown in FIG. 1.
Figure 3:
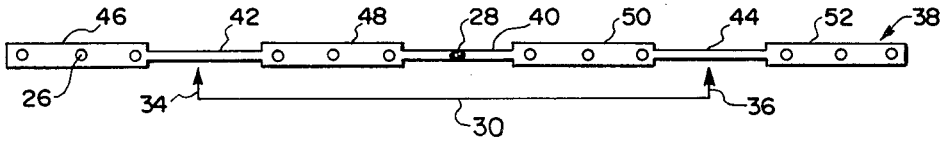
FIG. 3 is a schematic view of the main and auxiliary fusible elements of the embodiment of the invention described herein, in which these elements are illustrated in linear form rather than in helically wound form similar to FIG. 2.

Except for the main fusible ribbon 14 and its associated "M" spot 28, the remaining elements in the improved fuse disclosed herein are basically the same as those shown for the fuse 10 in FIG. 1. Thus, to best illustrate the differences between the fusible ribbon 14 and an improved fusible ribbon 38 disclosed herein, these two ribbons 14, 38, have been respectively shown in linear form in FIGS. 2 and 3, together with a schematic representation of the auxiliary winding 30 and the air gap electrodes 34, 36. The improved fusible ribbon 38 shown in FIG. 3, includes three elongated portions 40, 42, 44 of uniform cross section, each having a cross sectional area substantially less than the largest cross sectional area of the remaining portions 46, 48, 50, 52 of the ribbon 38 adjoining these sections 40, 42, 44. The remaining portions 46, 48, 50, 52 of the fusible ribbon 38 is identical in construction to the fusible ribbon 14 described above, wherein each portion 46, 48, 50, 52 contains a plurality of the uniformly spaced circular perforations 26 therethrough to define fusion points of minimal cross sectional area along the tape 38. The "M" spot 28 is disposed at approximately the midpoint of the center section 40, and the arc gap electrodes 34, 36 are disposed and spaced from the approximate midpoint of a respective one of the sections 42, 44.

Figure 4A:
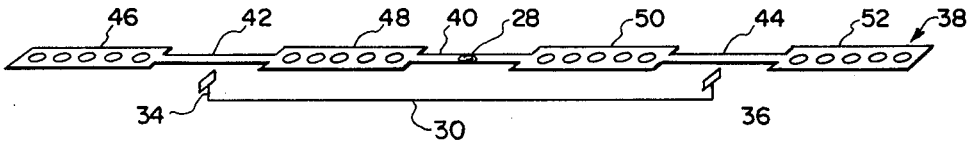
Figure 4A:
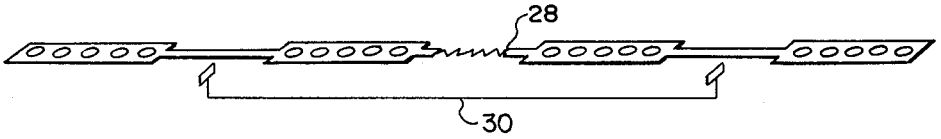
Figure 4A:
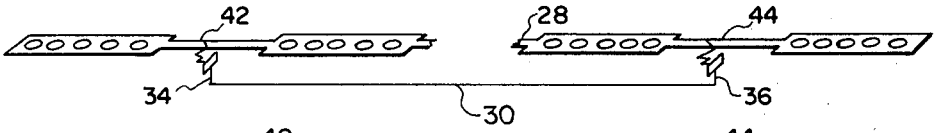
Figure 4A:
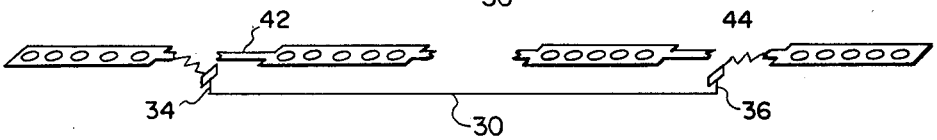
Figure 4A:
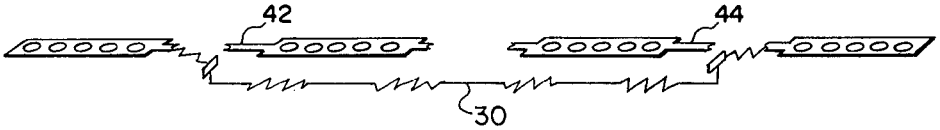
Figure 4A:
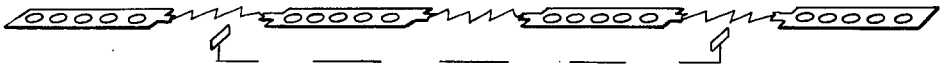
Figure 4A:
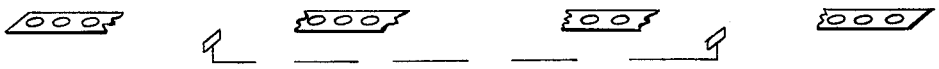

Under relatively small but prolonged overload currents, the fusible element 38 melts first at its "M" spot 28 at the midpoint of the center section 40 of reduced cross sectional area, and begins to burn back under the initial arc formed at this point as shown schematically in FIG. 4*b*. Because of the reduced width and cross sectional area of this center portion 40, the fuse element 38 burns back at a much faster rate than the conventional fuse element 14. When the arc voltage across this area is high enough, the auxiliary air gaps 34, 36 spark over, diverting the main current flow from the main fusible element 38 to the auxiliary fuse element 30, and extinguishing the arc across the "M" spot portion of the fuse element 38, as shown in FIG. 4*c*. During the time the auxiliary element 30 is conducting, the fulgurite at the center portion 40 of the main ribbon 38 starts to cool and lose its conductivity. Since the main fuse element 38 has a higher rate of burn back along the reduced area section 40 than the conventional main element 14, the arcing time across this point is shortened and less heat is generated, so that the fulgurite at this point requires less cooling time to lose its conductivity than that required if a conventional main element fusible ribbon 14 were used.

When the arc gap electrodes 34, 36 spark over, the intense heat of the arc between these electrodes and the main element quickly burns open the sections 42, 44 of reduced width and cross sectional area at approximately their respective midpoints, and these sections start to burn back towards their respective ends of the fuse element 38, as schematically shown in FIG. 4*d*. Again, the rate in which the main fuse element 38 burns back at these portions 42, 44 adjacent the air gap electrodes 34, 36 is higher than the rate at which the conventional main fusible element 14 will burn back opposite these electrodes 34, 36 for the same fault current, thus distributing the heat generated by these arcs over a longer portion of the fuse. When the auxiliary element 30 vaporizes, as shown in FIG. 4*e*, the circuit is interrupted and the arcs at the electrodes 34, 36 are extinguished. Because of the shorter arcing time across the "M" spot section of the fuse element 38 and the greater length of fuse consumed at the sections 40, 42 44 of this fuse element 38, in comparison with the conventional main fuse element 14, the fusible element 38 will have a higher withstand voltage than the fuse element 14, for the same low magnitude overload current. However, if the system recovery voltage is higher than the withstand voltage of the fusible element 38, arcing will be reestablished across the remaining sections of the main element 38, and these sections of the main element 38 will burn back until a sufficient dielectric path is established to withstand the recovery voltage across the fuse element.

The sections 46, 48, 50, 52 of punched ribbon are retained in the improved fusible element 38 between the sections 40, 42, 44 of reduced cross sectional area for control of the fuse's arc voltage on high levels of fault current. The lengths of the reduced areas 40, 42, 44 is critical in that too long of a total length will detrimentally increase the arc voltage on high fault currents, and too short of a total length will reduce the beneficial effects on the arcing time at low magnitude overload currents. For example, in modifying a four foot length of 3/16 inch wide, 0.005 inch thick silver ribbon 14 for a 23 Kv fuse, having $\frac{1}{8}$ inch circular perforations spaced $\frac{1}{2}$ inch apart, to a ribbon 38 for the same 23 Kv fuse, it has been found that a good ratio of the length of the reduced areas 40, 42, 44 to the overall length of the fusible ribbon 38 is 0.375, with each reduced area 40, 42, 44 being 6 inches long.

Also, the cross sectional area of each section 40, 42, 44 of the fusible element 38 must be at least as great as the cross sectional area of the fuse across one of the circular perforations 26 so that the ability of the fuse to withstand transient surge currents is not impaired. Preferably, since the thermal conductivity across the sections 40, 42, 44 to adjacent full width areas of the ribbon is less than that of a perforated portion 26, the cross sectional area of these sections 40, 42, 44 is somewhat larger than the cross sectional area of the remaining portions 46–52 across one of the perforations 26, to provide the same short time overcurrent capability as known fuses of this type, and to assure that the sections 40, 42, 44 melt open at approximately the same time as the other reduced sections at the perforation 26 during a high magnitude fault current.

Thus for a main fusible element 38 having perforated portions 26 whose cross sectional area is one-third the cross sectional area of an adjacent unperforated section of the tape 38, and having identical reduced area sections 40, 42, 44 whose combined length is $37\frac{1}{2}$ percent the overall length of the fusible ribbon 38, such as the four foot length of silver ribbon 38 mentioned above, it has been found that an acceptable ratio of the widths of the reduced area sections 40, 42, 44 lies in the range of one-third to one-half the full width of the ribbon 38.

Since the heat generated by current flowing through the central section 40 will produce a higher temperature rise in this section than the same current flowing through the conventional fusible element 14 at its "M" spot 38, the alloy used for the "M" spot of the fusible element 38 will have a somewhat higher melting temperature than the similar alloy used for the "M" spot of a conventional fuse element 14, to thus assure that the minimum melt characteristics remains unchanged.

In overcurrent tests conducted on two groups of 40 ampere, 23 Kv current limiting fuses of the type disclosed by the above-referenced U.S. Pat. No. 3,243,552, in which a first group of fuses employed the above-mentioned 4 foot lengths of silver ribbon 14 for the main fusible element 12 and the second group of fuses used the modified 4 foot lengths of silver ribbon 38 for the main element 12, it was found that the use of these fusible ribbons 38 disclosed herein reduced the number of arc cycles required to clear low current faults (150% of the fuse rated current) by 38% to 52%. At intermediate fault currents (500%–600% of fuse rated current), the use of these fusible ribbons 38 reduced the number of arc cycles required to clear the fault current by 56% to 74%, and at high fault currents (100 times the fuse rated current), the use of the ribbons 38 reduced the arc voltage by 9%. The minimum melt $I^2t$, TCC, and let through $I^2t$ values of the fuse were unchanged by the use of these fusible ribbons 38.

This improved main fusible ribbon 38 can also be used in a current limiting fuse which includes a high resistance indicator wire connected between one of the air gap electrodes 34, 36 and one of the fuse terminals 22, 24, as described in the above-referenced U.S. Pat. No. 3,243,552. Also, it is obvious that this fuse element 38 can be modified to include additional sections of reduced cross sectional area, similar to sections 42, 44, for use with an auxiliary fusible element at more than two points along its length closely spaced from the main fusible element, or for use with several auxiliary fusible elements 30 each having its ends individually spaced from the main fusible element 38, similar to those described in the above-referenced U.S. Pat. No. 3,243,552. Other modifications and variations will be readily apparent to those skilled in the art, and consequently is intended in the appended claims to cover all such modifications and variations which fall within the scope of the invention.

What is claimed is:

1. In a high voltage, current limiting fuse having a main fusible element which includes a plurality of serially related sections of relatively large cross-sectional area connected by intermediate sections of relatively small cross-sectional area, a body of low melting temperature alloy in intimate contact with a central porton of the main fusible element, and at least one auxiliary fusible element, each auxiliary element having at least one pair of terminals spaced slightly from other portions of the main fusible element on opposite sides of the body of alloy to form respective air gaps with the main element, the improvement wherein:

said central portion and said other portions of the main element forming air gaps with said auxiliary element terminals, each comprise an elongated portion extending between adjoining portions of the main element, said adjoining portions including said serially related large and small sections, each said elongated portion having a cross-sectional area at any point along its extent substantially less than the largest cross-sectional area of said serially related large sections and at least as large as the smallest cross-sectional area of said serially related small sections, the length of each elongated portion being substantially greater than the length of any one of said serially related small sections.

2. An improved current limiting fuse, as described in claim 1, wherein the cross-sectional area of each elongated portion at any point along its extent is less than half the largest cross-sectional area of said serially related large sections of said adjoining portions of the main element.

3. An improved current limiting fuse, as described in claim 2, wherein the combined length of said elongated portions is less than half the overall length of the main fusible element.

* * * * *